US006155522A

United States Patent [19]

Anderson

[11] Patent Number: 6,155,522

[45] Date of Patent: Dec. 5, 2000

[54] YARD DEBRIS COLLECTING SYSTEM

[76] Inventor: Samuel Gregory Anderson, 159 S. Glenellen Ave., Youngstown, Ohio 44509

[21] Appl. No.: 09/410,322

[22] Filed: Oct. 1, 1999

[51] Int. Cl.[7] ..... B65B 67/04

[52] U.S. Cl. ..... 248/99; 248/101; 248/95; 248/146; 248/150

[58] Field of Search ..... 248/99, 95, 101, 248/97, 98, 100, 910, 146, 150; 383/12, 33; 294/55; 15/257.1, 257.9; 56/202, 194, 327.1

[56] References Cited

U.S. PATENT DOCUMENTS

| | | | |
|---|---|---|---|
| D. 42,974 | 9/1912 | Nelson . | |
| D. 399,103 | 11/1998 | Lillelund et al. . | |
| 4,312,531 | 1/1982 | Cross | 294/55 |
| 4,693,504 | 9/1987 | Baker | 294/1.1 |
| 4,697,835 | 10/1987 | Scott | 294/55 |
| 4,832,292 | 5/1989 | Beckham . | |
| 5,011,103 | 4/1991 | Hayes et al. . | |
| 5,048,778 | 9/1991 | Wright | 248/98 |
| 5,090,756 | 2/1992 | Pfisterer | 294/1.1 |
| 5,106,041 | 4/1992 | Jelincic . | |
| 5,107,666 | 4/1992 | Rahtican . | |
| 5,498,046 | 3/1996 | Ridley, Sr. et al. | 294/1.1 |
| 5,593,117 | 1/1997 | Alexander, III | 248/99 |
| 5,785,369 | 7/1998 | Ridley, Sr. et al. | 294/1.1 |
| 6,003,820 | 12/1999 | Baldonado et al. | 248/99 |
| 6,085,647 | 7/2000 | Burow | 100/295 |

*Primary Examiner*—Anita M. King
*Assistant Examiner*—Naschica C Sanders

[57] ABSTRACT

A yard debris collecting system for providing a chute for facilitating the insertion of lawn debris into a collection bag. The yard debris collecting system includes a pivoted frame, a chute couplable to the frame, a collection bag couplable to the frame such that the chute extends into and opens into the open bag. In an embodiment, a packing tool is provided for compacting debris within the collection bag. In an embodiment, a distal lower edge of the chute is weighted for holding the distal lower edge against the ground during use.

13 Claims, 4 Drawing Sheets

YARD DEBRIS COLLECTING SYSTEM

BACKGROUND OF THE INVENTION

1. Field of the Invention

The present invention relates to trash and lawn bag holders and more particularly pertains to a new yard debris collecting system for providing a chute for facilitating the insertion of lawn debris into a collection bag.

2. Description of the Prior Art

The use of trash and lawn bag holders is known in the prior art. More specifically, trash and lawn bag holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,107,666; U.S. Pat. No. 5,106,041; U.S. Pat. No. 4,832,292; U.S. Pat. No. 5,011,103; U.S. Pat. No. Des. 42,974; and U.S. Pat. No. Des. 399,103.

While these devices fulfill their respective, particular objectives and requirements, the aforementioned patents do not disclose a new yard debris collecting system. The inventive device includes a pivoted frame, a chute couplable to the frame, a collection bag couplable to the frame such that the chute extends into and opens into the open bag. In an embodiment, a packing tool is provided for compacting debris within the collection bag.

In these respects, the yard debris collecting system according to the present invention substantially departs from the conventional concepts and designs of the prior art, and in so doing provides an apparatus primarily developed for the purpose of providing a chute for facilitating the insertion of lawn debris into a collection bag.

SUMMARY OF THE INVENTION

In view of the foregoing disadvantages inherent in the known types of trash and lawn bag holders now present in the prior art, the present invention provides a new yard debris collecting system construction wherein the same can be utilized for providing a chute for facilitating the insertion of lawn debris into a collection bag.

The general purpose of the present invention, which will be described subsequently in greater detail, is to provide a new yard debris collecting system apparatus and method which has many of the advantages of the trash and lawn bag holders mentioned heretofore and many novel features that result in a new yard debris collecting system which is not anticipated, rendered obvious, suggested, or even implied by any of the prior art trash and lawn bag holders, either alone or in any combination thereof.

To attain this, the present invention generally comprises a pivoted frame, a chute couplable to the frame, a collection bag couplable to the frame such that the chute extends into and opens into the open bag. In an embodiment, a packing tool is provided for compacting debris within the collection bag.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new yard debris collecting system apparatus and method which has many of the advantages of the trash and lawn bag holders mentioned heretofore and many novel features that result in a new yard debris collecting system which is not anticipated, rendered obvious, suggested, or even implied by any of the prior art trash and lawn bag holders, either alone or in any combination thereof.

It is another object of the present invention to provide a new yard debris collecting system that may be easily and efficiently manufactured and marketed.

It is a further object of the present invention to provide a new yard debris collecting system that is of a durable and reliable construction.

An even further object of the present invention is to provide a new yard debris collecting system which is susceptible of a low cost of manufacture with regard to both materials and labor, and which accordingly is then susceptible of low prices of sale to the consuming public, thereby making such yard debris collecting system economically available to the buying public.

Still yet another object of the present invention is to provide a new yard debris collecting system which provides in the apparatuses and methods of the prior art some of the advantages thereof, while simultaneously overcoming some of the disadvantages normally associated therewith.

Still another object of the present invention is to provide a new yard debris collecting system for providing a chute for facilitating the insertion of lawn debris into a collection bag.

Yet another object of the present invention is to provide a new yard debris collecting system which includes a pivoted frame, a chute couplable to the frame, a collection bag couplable to the frame such that the chute extends into and opens into the open bag. In an embodiment, a packing tool is provided for compacting debris within the collection bag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
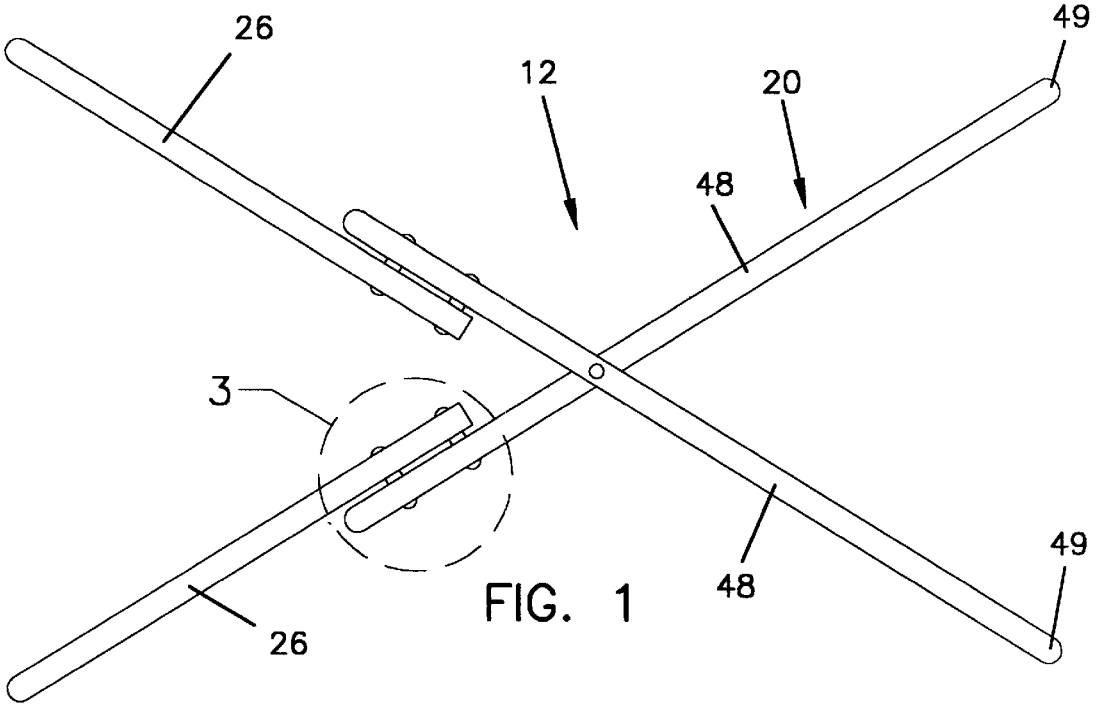
FIG. 1 is a schematic top view of the frame of a new yard debris collecting system according to the present invention.
Figure 2:
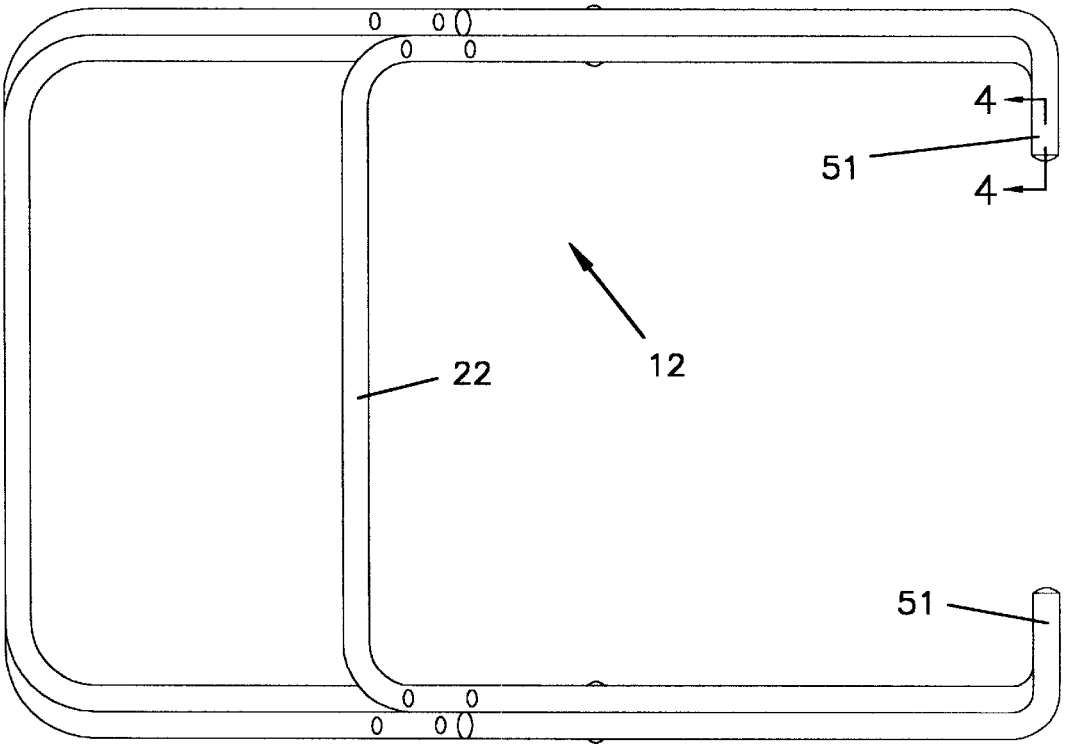
FIG. 2 is a schematic side view of the frame of the present invention.
Figure 3:
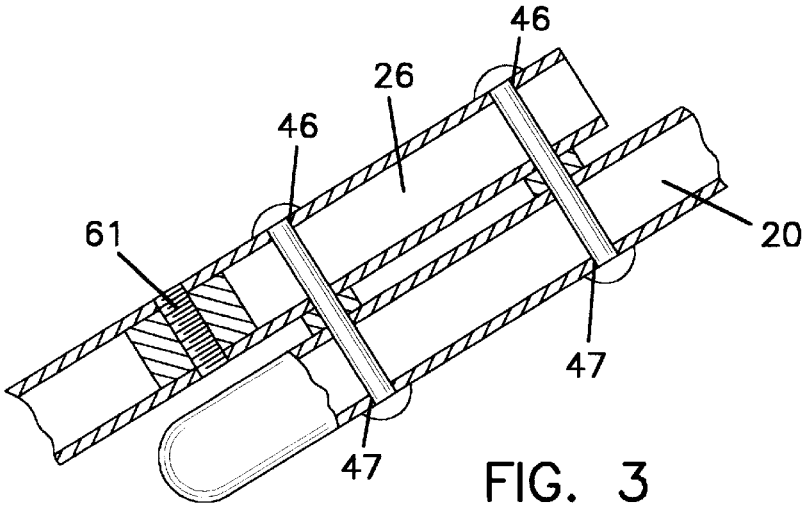
FIG. 3 is a schematic enlarged view of the area designated 3 in FIG. 1.
Figure 4:
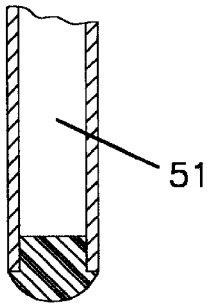
FIG. 4 is a schematic cross-sectional view taken along line 4—4 of FIG. 2.
Figure 5:
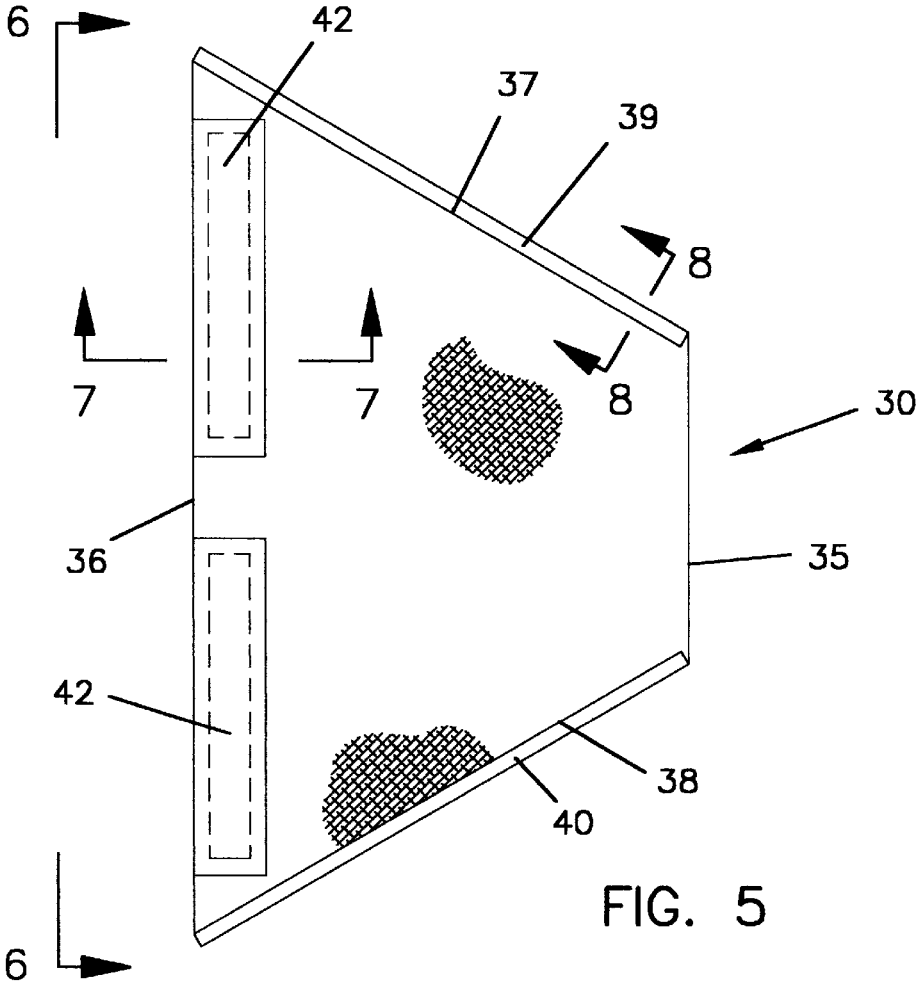
FIG. 5 is a schematic top view of the chute assembly of the present invention.
Figure 6:
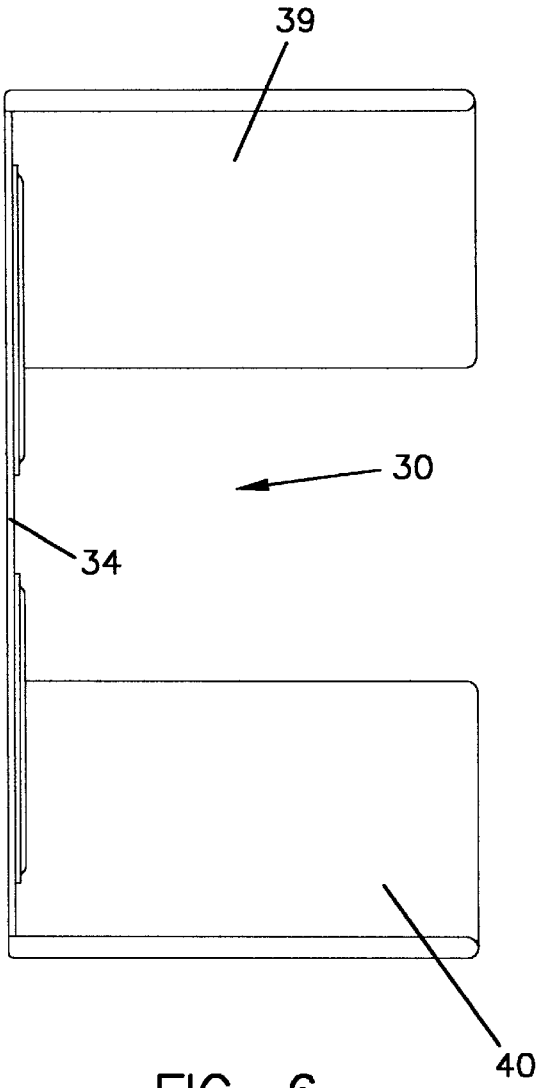
FIG. 6 is a schematic front view of the chute assembly of the present invention.
Figure 7:
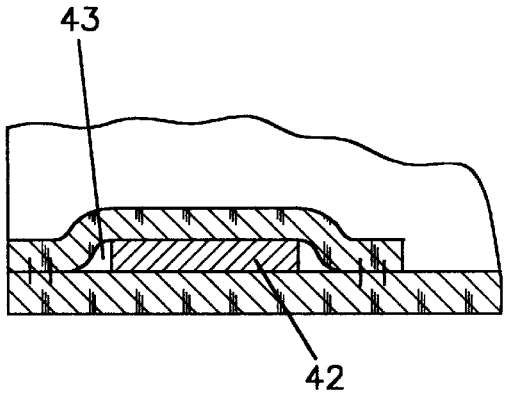
FIG. 7 is a schematic cross-sectional view taken along line 7—7 of FIG. 5.
Figure 8:
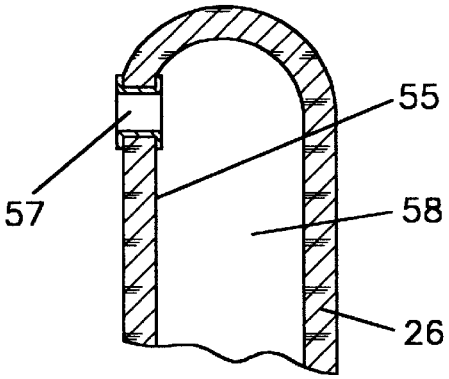
FIG. 8 is a schematic cross-sectional view taken along line 8—8 of FIG. 5.
Figure 9:
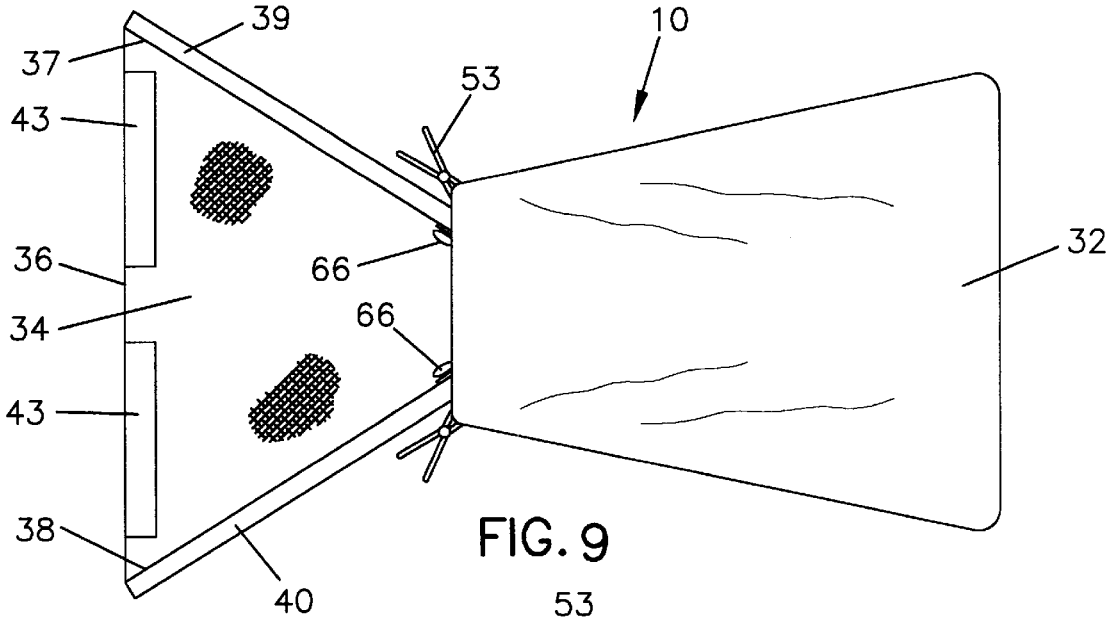
FIG. 9 is a schematic top view of the present invention.
Figure 10:
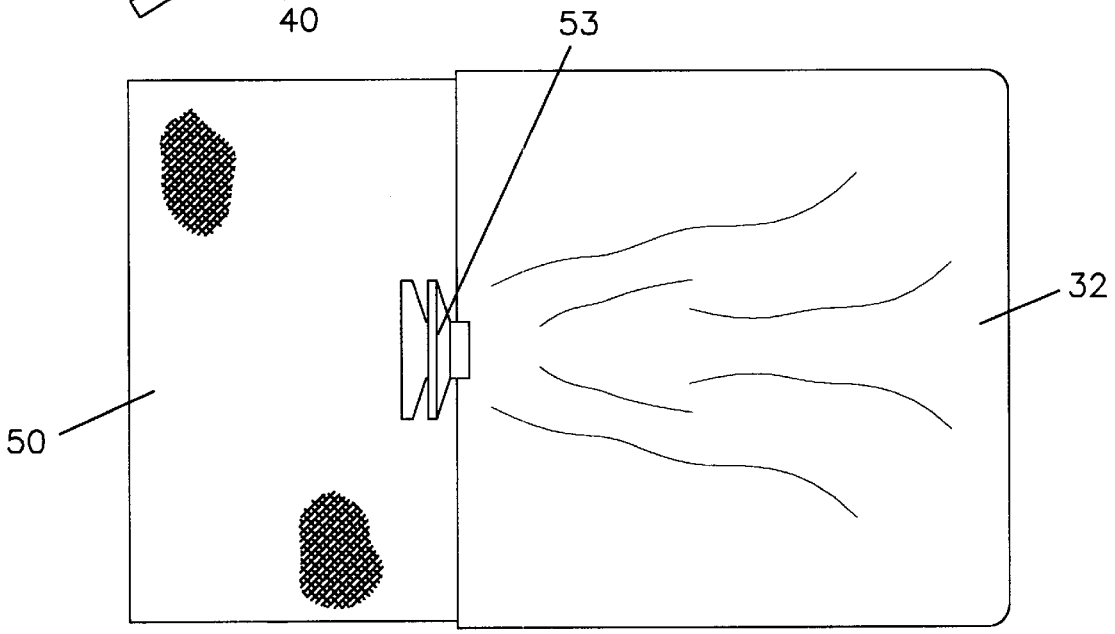
FIG. 10 is a schematic side view of the present invention.
Figure 11:
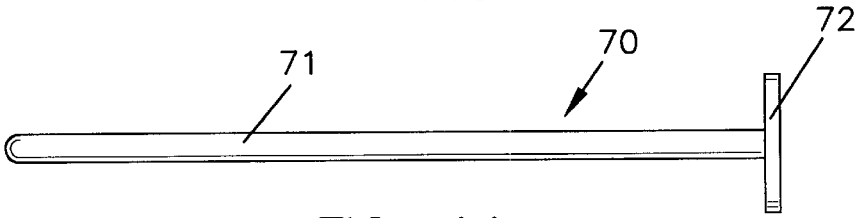
FIG. 11 is a schematic side view of the debris packing tool of the present invention.
Figure 12:
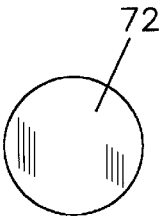
FIG. 12 is a schematic end view of the debris packing tool of the present invention.

With reference now to the drawings, and in particular to FIGS. 1 through 12 thereof, a new yard debris collecting system embodying the principles and concepts of the present invention and generally designated by the reference numeral 10 will be described.

As best illustrated in FIGS. 1 through 12, the yard debris collecting system 10 generally comprises a frame 12 including a first pair of generally U-shaped arms 20. The first pair of arms are pivotally coupled to each other such that the frame is pivotable between an open position and a closed position. The open position is defined by respective cross-members 22 of the U-shaped arms being spaced apart with respect to each other. The closed position is defined by the cross-members being positioned adjacent to each other.

The frame further includes a pair of generally U-shaped extension arms 26. Each of the extension arms is coupled to a respective one of the first pair of arms. The extension arms are designed for holding a chute assembly 30.

A collection bag 32 is couplable to the first pair of arms such that the chute extends into the collection bag when the collection bag is coupled to the first pair of arms.

The chute assembly includes a base panel 34 including an interior edge 35, a distal edge 36, and a pair of opposite side edges 37 and 38. The chute assembly further includes a pair of side walls 39 and 40 extending upwardly from the opposite side edges of the base panel.

In an embodiment, a pair of elongated weight members 42 are coupled to the base panel proximate the distal edge. Each weight member is positioned within a weight pocket 43 positioned parallel to the distal edge.

In an embodiment, the distal edge of the base panel has a length greater than a length of the interior edge of the base panel such that the side edges taper towards each other as they approach the interior edge of the base panel.

The base panel is most preferably flexible such that the side panels are positionable adjacent to each other when the frame is in the closed position. Thus, the chute assembly does not have to be removed from the frame as the frame is pivoted between the open and closed positions.

Each of the extension arms includes a plurality of frame connection apertures 46. The frame includes a plurality of extension arm connection apertures 47. Each extension arm connection aperture is alignable with an associated one of the frame connection apertures. The system 10 includes a plurality of connection pins. Each of the connection pins is insertable through a respective one of the extension arm connection apertures and an aligned frame connection aperture for coupling the extension arms to the frame.

Each one of the first pair of arms includes a pair of parallel side portions 48, each including a distal end 49.

Each distal end of each side portion includes an extension portion 51 for preventing the side portions from puncturing the collection bag when the collection bag is coupled to the frame.

Clip members 53 are provided for coupling the collection bag to the cross-members of the U-shaped arms.

In an embodiment, each of the side walls of the chute forms a pocket 55 for receiving a respective one of the extension arms. Each side wall of the chute includes a hole 57 extending through the side wall into an interior 58 of the pocket.

Each of the extension arms includes a respective threaded chute connection aperture 61. The threaded chute connection aperture is alignable within the pocket with the hole 57 in the side wall.

A pair of chute screw members 66 are provided for insertion through an associated one of the holes in the side wall. Each of the chute screw members is couplable to an associated one of the threaded chute connection apertures, thus the chute is couplable to the extension arms.

A compaction tool 70 is also provided having an elongated handle portion 71 and a head portion 72. The head portion is generally disk shaped and the handle portion extends orthogonally from a center of the disk portion.

In use, the frame is held in the closed position with the chute assembly coupled to the frame. The collection bag is then placed over the distal ends of the first pair of arms and the collection bag is clipped to the cross-members of the first pair of arms. The frame is then opened, opening the collection bag and expanding the chute. Lawn debris can then be raked or swept through the chute into the collection bag. The compaction tool is used to compress collected debris within the collection bag.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lawn debris collection system, comprising:

a frame, said frame having a first pair of generally U-shaped arms, said first pair of arms being pivotally coupled to each other such that said frame is pivotable between an open position and a closed position, said open position being defined by respective cross-members of said U-shaped arms being spaced apart with respect to each other, said closed position being defined by said cross-members being positioned adjacent to each other;

said frame further including a pair of generally U-shaped extension arms, each of said extension arms being coupled to a respective one of said first pair of arms;

a chute assembly coupled to said extension arms;

a collection bag couplable to said first pair of arms such that said chute extends into said collection bag when said collection bag is coupled to said first pair of arms.

2. The lawn debris collection system of claim 1, further comprising:

said chute including a base panel having an interior edge, a distal edge, and a pair of opposite side edges;

said chute further including a pair of side walls extending upwardly from the opposite side edges of the base panel.

3. The lawn debris collection system of claim 2, further comprising:

a pair of elongated weight members, said weight members being coupled to said base panel proximate said distal edge.

4. The lawn debris collection system of claim 2, further comprising:

said distal edge of said base panel having a length greater than a length of said interior edge of said base panel such that said side edges taper towards each other as they approach said interior edge of said base panel.

5. The lawn debris collection system of claim 2, further comprising:

said base panel being flexible such that said side panels are positioned adjacent to each other when said frame is in said closed position.

6. The lawn debris collection system of claim 1, further comprising:

each side wall of said chute having a hole therein;

each of said extension arms having a respective threaded chute connection aperture; and a pair of chute screw members, each of said chute screw members being insertable through an associated one of said holes in said chute, each of said chute screw members being couplable to an associated one of said threaded chute connection apertures, whereby said chute is couplable to said extension arms.

7. The lawn debris collection system of claim 1, further comprising:

each of said extension arms having a plurality of frame connection apertures;

said frame having a plurality of extension arm connection apertures, each extension arm connection aperture being alignable with an associated one of said frame connection apertures;

a plurality of connection pins, each of said connection pins being insertable through a respective one of said extension arm connection apertures and an aligned frame connection aperture whereby said extension arms are coupled to said frame.

8. The lawn debris collection system of claim 1, further comprising:

each one of said first pair of arms having a pair of parallel side portions, each side portion having a distal end;

each distal end of each said side portion having an extension portion for preventing said side portions from puncturing said collection bag when said collection bag is coupled to said frame.

9. The lawn debris collection system of claim 1, further comprising:

a plurality of clip members, each clip member being for coupling said collection bag to an associated cross-member of said U-shaped arms.

10. The lawn debris collection system of claim 1, further comprising:

upper side wall of said chute forming a pocket for receiving a respective one of said extension arms.

11. The lawn debris collection system of claim 10, further comprising:

each side wall of said chute having a hole extending through said side wall into an interior of said pocket;

each of said extension arms having a respective threaded chute connection aperture, said threaded chute connection aperture being alignable within said pocket with said hole in said side wall; and a pair of chute screw members, each of said chute screw members being insertable through an associated one of said holes in said side wall, each of said chute screw members being couplable to an associated one of said threaded chute connection apertures, whereby said chute is couplable to said extension arms.

12. A lawn debris collection system, comprising:

a frame, said frame having a first pair of generally U-shaped arms, said first pair of arms being pivotally coupled to each other such that said frame is pivotable between an open position and a closed position, said open position being defined by respective cross-members of said U-shaped arms being spaced apart with respect to each other, said closed position being defined by said cross-members being positioned adjacent to each other;

said frame further including a pair of generally U-shaped extension arms, each of said extension arms being coupled to a respective one of said first pair of arms;

a chute assembly coupled to said extension arms;

a collection bag couplable to said first pair of arms such that said chute extends into said collection bag when said collection bag is coupled to said first pair of arms;

said chute including a base panel having an interior edge, a distal edge, and a pair of opposite side edges;

said chute further including a pair of side walls extending upwardly from the opposite side edges of the base panel;

a pair of elongated weight members, said weight members being coupled to said base panel proximate said distal edge;

said distal edge of said base panel having a length greater than a length of said interior edge of said base panel such that said side edges taper towards each other as the side edges approach said interior edge of said base panel;

said base panel being flexible such that said side panels are positioned adjacent to each other when said frame is in said closed position;

each of said extension arms having a plurality of frame connection apertures;

said frame having a plurality of extension arm connection apertures, each extension arm connection aperture being alignable with an associated one of said frame connection apertures;

a plurality of connection pins, each of said connection pins being insertable through a respective one of said extension arm connection apertures and an aligned frame connection aperture whereby said extension arms are coupled to said frame;

each one of said first pair of arms having a pair of parallel side portions, each side portion having a distal end;

each distal end of each said side portion having an extension portion for preventing said side portions from puncturing said collection bag when said collection bag is coupled to said frame;

a plurality of clip members, each clip member being for coupling said collection bag to an associated cross-member of said U-shaped arms;

each of said side walls of said chute forming a pocket for receiving a respective one of said extension arms;

each side wall of said chute having a hole extending through said side wall into an interior of said pocket;

each of said extension arms having a respective threaded chute connection aperture, said threaded chute connection aperture being alignable within said pocket with said hole in said side wall; and a pair of chute screw members, each of said chute screw members being insertable through an associated one of said holes in said side wall, each of said chute screw members being couplable to an associated one of said threaded chute connection apertures, whereby said chute is couplable to said extension arms.

13. The lawn debris collection assembly of claim 12, further comprising:

a compaction tool having an elongated handle portion and a head portion, the head portion being generally disk shaped, the handle portion extending orthogonally from a center of the disk portion.

* * * * *